US008552629B2

(12) United States Patent
Inohara et al.

(10) Patent No.: US 8,552,629 B2
(45) Date of Patent: Oct. 8, 2013

(54) SPARK PLUG DESIGNED TO ENSURE DESIRED DEGREE OF IGNITABILITY OF FUEL

(75) Inventors: Takayuki Inohara, Okazaki (JP); Shinichi Okabe, Aichi-ken (JP); Takanobu Aochi, Nishio (JP); Atsushi Iwami, Kariya (JP); Masamichi Shibata, Toyota (JP)

(73) Assignees: Nippon Soken, Inc., Nishio (JP); Denso Corporation, Kariya (JP)

( * ) Notice: Subject to any disclaimer, the term of this patent is extended or adjusted under 35 U.S.C. 154(b) by 0 days.

(21) Appl. No.: 13/546,327

(22) Filed: Jul. 11, 2012

(65) Prior Publication Data

US 2013/0015755 A1 Jan. 17, 2013

(30) Foreign Application Priority Data

Jul. 11, 2011 (JP) ..... 2011-153150
Apr. 2, 2012 (JP) ..... 2012-083878

(51) Int. Cl.
*H01T 13/20* (2006.01)

(52) U.S. Cl.
USPC ..... 313/141; 313/142; 313/118

(58) Field of Classification Search
USPC ..... 313/141–142
See application file for complete search history.

(56) References Cited

U.S. PATENT DOCUMENTS

| | | | | |
|---|---|---|---|---|
| 5,202,601 | A * | 4/1993 | Takamura et al. | 313/142 |
| 5,574,329 | A * | 11/1996 | Kagawa | 313/141 |
| 6,307,307 | B1 * | 10/2001 | Kanao | 313/142 |
| 6,337,533 | B1 * | 1/2002 | Hanashi et al. | 313/141 |
| 2002/0036450 | A1 * | 3/2002 | Nishikawa | 313/118 |
| 2007/0216276 | A1 * | 9/2007 | Takada | 313/141 |

FOREIGN PATENT DOCUMENTS

| | | |
|---|---|---|
| JP | 54-158538 | 12/1979 |
| JP | 9-148045 | 6/1997 |
| JP | 2005-50612 | 2/2005 |

* cited by examiner

*Primary Examiner* — Mary Ellen Bowman
(74) *Attorney, Agent, or Firm* — Nixon & Vanderhye, PC

(57) ABSTRACT

A spark plug for an internal combustion engine is provided which is equipped with a tip protrusion disposed on a top of a hollow cylindrical housing of the spark plug. The spark plug also includes a center electrode retained in a porcelain insulator disposed inside the housing and a ground electrode is joined to the housing so as to form a spark gap. The tip protrusion serves to direct a flow of gas to be ignited by a spark produced in the spark gap and is shaped to have a radial width extending in a radial direction of the housing and a circumferential width extending in a circumferential direction of the cylindrical housing. The radial width is greater than the circumferential width. This enhances the efficiency in guiding the flow of gas toward the spark gap.

8 Claims, 13 Drawing Sheets

SPARK PLUG DESIGNED TO ENSURE DESIRED DEGREE OF IGNITABILITY OF FUEL

CROSS REFERENCE TO RELATED DOCUMENT

The present application claims the benefit of priority of Japanese Patent Application Nos. 2011-153150 filed on Jul. 11, 2011 and 2012-83878 filed on Apr. 2, 2012, the disclosures of which are incorporated herein by reference.

BACKGROUND OF THE INVENTION

1. Technical Field

This disclosure relates generally to an improved structure of a spark plug which may be used in internal combustion engines for automotive vehicles and is designed to ensure a desired degree of ignitability of fuel.

2. Background Art

Spark plugs for automotive internal combustion engines are known which have a center electrode extending in an axial direction of the spark plug with a top end facing a ground electrode to form a spark gap therebetween. This type of spark plugs work to develop sparks across the gap to ignite an air-fuel mixture in a combustion chamber of the engine.

Generally, rotating streams of the mixture such as a swirl or a tumble are created within the combustion chamber. Such streams at least partially passes through the spark gap, thereby ensuring the ignitability of the mixture.

The part of the ground electrode welded to an end of a housing (usually called a metal shell) of the spark plug may be located upstream of the spark plug in terms of the streams of the mixture depending upon an angular orientation of the spark plug screwed into the head of the engine. This causes the streams of the mixture to be blocked partially by the ground electrode within the combustion chamber, so that they may stall near the spark gap, thus resulting in a decrease in ignitability of the mixture. The problem of a variation in ignitability of the mixture is, therefore, encountered depending upon the angular orientation of the spark plug installed in the engine. Recent years, a lot of lean-burn internal combustion engines have been used. Such type of engine may experience the instability of burning of fuel depending upon the angular orientation of the spark plug installed in the engine.

It is usually difficult to set the angular orientation or position of the ground electrode of the spark plug in a direction of rotation thereof. This is because it depends upon the geometry of a thread on the meta shell screwed into the engine head or the degree with which the thread is tightened into the engine head.

In order to alleviate the above problem, Japanese Patent First Publication No. 9-148045 teaches a spark plug designed to have the ground electrode with a hole through which the streams of the mixture is admitted to pass or joining of the ground electrode to the metal shell using a plurality of thin plates.

The hole in the ground electrode, however, results in a decrease in mechanical strength of the metal shell. An increase in thickness of the ground electrode in order to eliminate such a problem will also result in an increase in obstruction to the streams of the mixture toward the spark gap.

The use of the thin plates to join the ground electrode to the metal shell results in a complex structure of the spark plug and an increase in production costs thereof.

SUMMARY

It is therefore an object to provide a simple structure of a spark plug designed to ensure the stability in igniting fuel despite an angular orientation of the spark plug relative to an internal combustion engine.

According to one aspect of an embodiment, there is provided a spark plug which may be employed in igniting an air-fuel mixture in automotive engines. The spark plug includes: (a) a hollow cylindrical housing which has an open end; (b) a cylindrical porcelain insulator retained in the cylindrical housing; (c) a center electrode having a given length which is retained in the porcelain insulator with a tip thereof exposed outside an end of the porcelain insulator; (d) a ground electrode which is joined to the cylindrical housing so as to form a spark gap between itself and the tip of the center electrode; and (e) a tip protrusion which extends from the open end of the cylindrical housing. The tip protrusion is shaped to have a radial width that is a width extending in a radial direction of the cylindrical housing and a circumferential width that is a width extending in a circumferential direction of the cylindrical housing. The radial width is greater than the circumferential width.

The spark plug is, as described above, equipped with the tip protrusion extending from the open end of the housing. The tip protrusion works to ensure as much gas as possible flows toward the spark gap regardless of angular orientation or position of the spark plug installed in the engine. For instance, when the ground electrode is located more upstream than the spark gap in a flow of gas within a combustion chamber of the engine, the ground electrode will partially be an obstruction to the flow of gas to the spark gap. In such an event, the tip protrusion works to guide the flow of gas which has bypassed the ground electrode toward the spark gap, thus avoiding stalling of the gas around the spark gap to ensure the stability in igniting the gas within the combustion chamber of the engine.

The tip protrusion is simple in configuration or structure, thus resulting in no need for increasing production costs of the spark plug.

The radial width of the tip protrusion is, as described above, greater than the circumferential width thereof. This enhances the efficiency in directing the flow of gas which will pass the circumference of the spark plug toward the spark gap and minimizes adverse effects arising from the obstruction of the ground electrode to the flow of the gas toward the spark gap. In other words, in the case a portion of the ground electrode is located more upstream than the spark gap in the flow of gas, the greater the radial width of the tip protrusion, the greater the volume of the gas directed toward the spark gap, while the greater the circumferential width of the tip protrusion, the greater the degree of obstruction to the flow of gas toward the spark gap. The tip protrusion is, therefore, designed to have the radial width greater than the circumferential width in order to maximize the effects of directing the flow of gas to the spark gap.

In the preferred mode of the invention, the ground electrode has a circumferential width which is a width extending in the circumferential direction of the cylindrical housing. The circumferential width of the tip protrusion is smaller than the circumferential width of the ground electrode. This minimizes the obstruction to the flow of gas toward the spark gap.

The ground electrode may have an upright portion which extends from the cylindrical housing in a direction of the length of the cylindrical housing. The angle which a straight line extending through a center of the center electrode and a center of an upright portion of the ground electrode in the radial direction of the cylindrical housing makes with a straight line extending through the center of the center electrode and a side surface of the tip protrusion closer to the ground electrode on a plane extending perpendicular to an axial direction of the cylindrical housing is less than or equal to 120° and greater than 0°.

The ground electrode has a length extending in an axial direction of the spark plug. The tip protrusion has a length extending from the open end of the cylindrical housing in the axial direction of the spark plug. The length of the tip protrusion is smaller than that of the ground electrode, thereby avoiding a physical interference with any parts within the combustion chamber of the engine.

The tip protrusion is oriented to extend substantially parallel to an axial direction of the spark plug.

The spark plug may also include a second tip protrusion which extends from the open end of the cylindrical housing. The tip protrusion and the second tip protrusion are preferably located to be asymmetrical with respect to a plane extending through a longitudinal center line of the ground electrode and a longitudinal center line of the center electrode. This causes directions of flows of gas guided by the respective tip protrusions to the spark gap to be asymmetrical with respect to the plane extending through the longitudinal center line of the ground electrode and the longitudinal center line of the center electrode in the case where the ground electrode is located more upstream than the spark gap in the flows of gas. This minimizes the possibility of the gas staying around the spark plug.

The second protrusion may be shaped to have a second radial width that is a width extending in the radial direction of the cylindrical housing and a second circumferential width that is a width extending in the circumferential direction of the cylindrical housing, the second radial width being greater than the second circumferential width.

The upright portion of the ground electrode extend substantially in a direction in which the tip protrusion extends from the open end of the cylindrical housing. The tip protrusion(s) is shaped to work as a flow-director to direct a flow of gas which is to be ignited by the spark plug.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings:

FIG. 11(*b*) is a transverse sectional view, as taken along the line B-B in FIG. 11(*a*);

DESCRIPTION OF THE PREFERRED EMBODIMENTS

Figure 1:
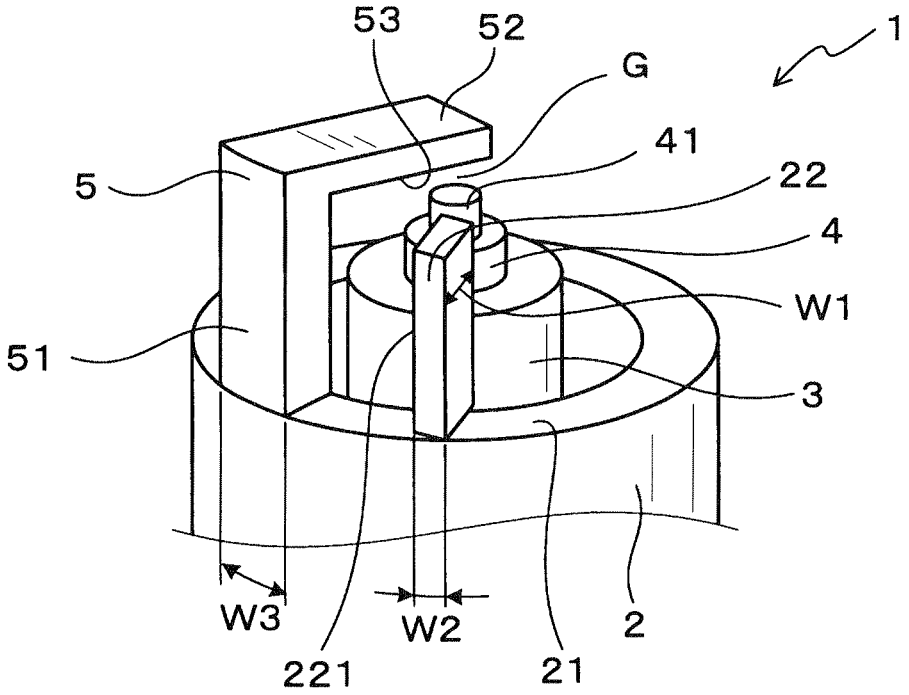
FIG. 1 is a partially perspective view which shows a spark plug according to the first embodiment.
Figure 2:
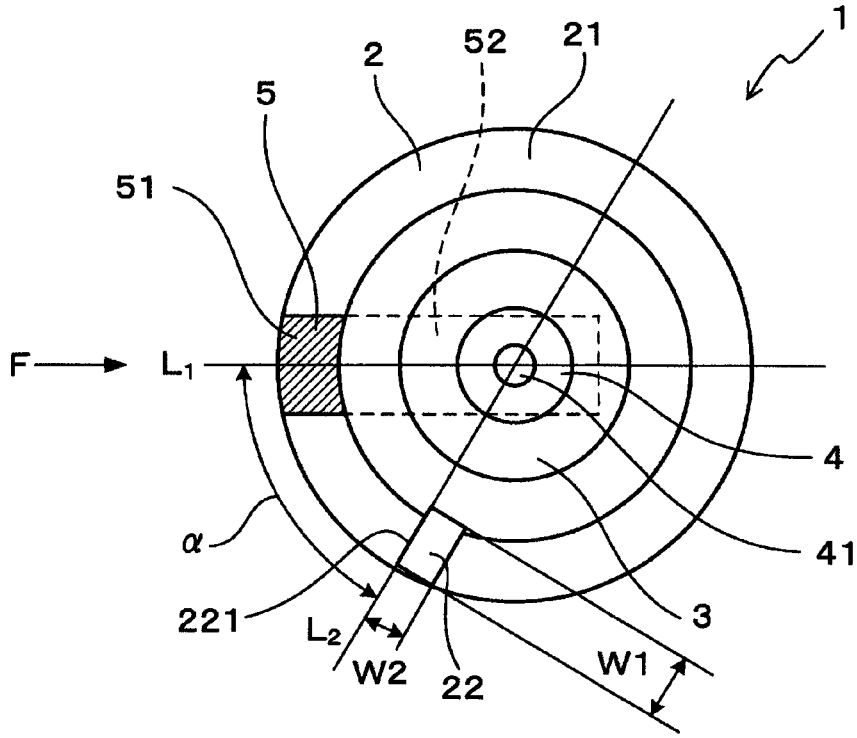
FIG. 2 is a partially sectional view which shows a top of the spark plug of FIG. 1.
Figure 3:
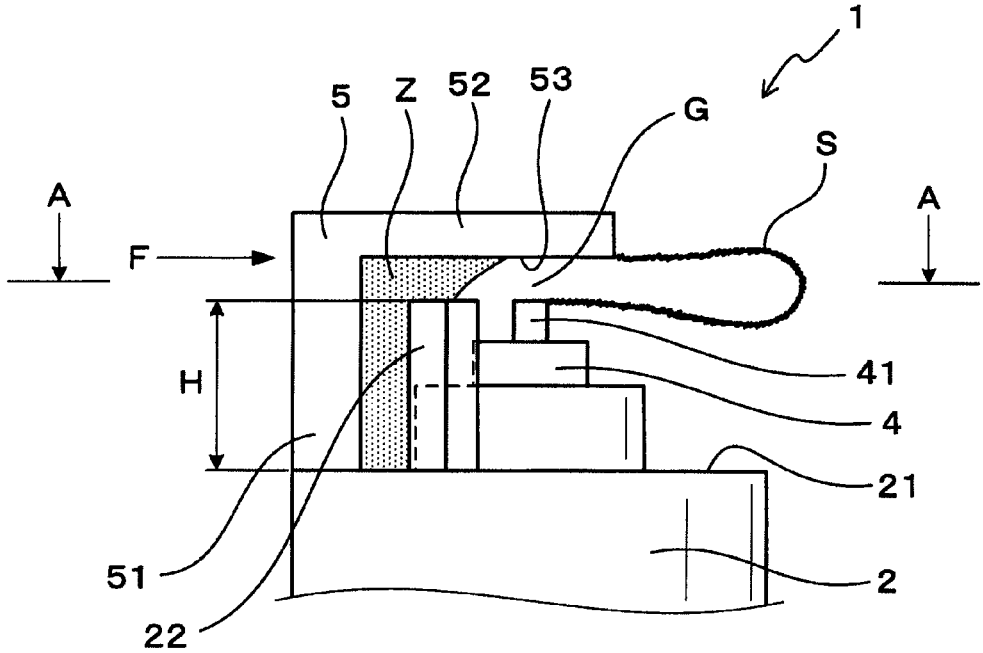
FIG. 3 is a partially side view of the spark plug of FIG. 1.

Referring to the drawings, wherein like reference numbers refer to like parts in several views, particularly to FIGS. 1 to 3, there is shown a spark plug 1 according to the first embodiment which is to be installed in an internal combustion engine mounted in, for example, automotive vehicles, motorcycles, co-generation systems, or gas feed pumps. The spark plug 1 works to produce a sequence of electric sparks to ignite an air/fuel mixture introduced into the internal combustion engine. The spark plug 1 is equipped with a hollow cylindrical metal shell 2 (also called a metal case or housing), a cylindrical porcelain insulator 3, and a center electrode 4. The porcelain insulator 3 is retained in the metal shell 2. The center electrode 4 is retained inside the porcelain insulator 3 with a top end 41 protruding from an end of the porcelain insulator 3. The spark plug 1 also includes a ground electrode 5 which is of an L-shape and joined to a top end 21 of the metal shell 2 to form a spark gap (also called an air gap) G between itself and the center electrode 4.

The spark plug 1 also has a single tip protrusion 22 extending from the top end (i.e., an open end) 21 of the metal shell 2 in a lengthwise direction of the spark plug 1.

The tip protrusion 22 has a rectangular traverse section with a width W1 extending in a radius direction of the spark plug 1 (i.e., the metal shell 2) and a width W2 extending in a circumferential direction of the spark plug 2 (i.e., the metal shell 2). The width W/is greater than the width W2.

The ground electrode 5 has a width W3 extending in the circumferential direction of the spark plug 1. The width W3 is greater than the width W2 of the tip protrusion 22.

FIG. 2 shows a transverse section of the spark plug 1 extending perpendicular to the length of the spark plug 1. The angle α which a straight line L1 extending through the center of the center electrode 4 and the center of an upright portion 51 of the ground electrode 5 in the radial direction of the spark plug 1 (i.e., the metal shell 2) makes with a straight line L2 extending through the center of the center electrode 4 and a flat side surface (i.e., a side end) 221 of the tip protrusion 22 closer to the ground electrode 5 on a plane extending perpendicular to the length of the spark plug 1 (i.e., the axial direction of the metal shell 2) is less than or equal to 120°. The angle α in this embodiment is 45°.

The tip protrusion 22, as clearly illustrated in FIG. 3, has a length H extending in the lengthwise or axial direction of the spark plug 1 (i.e., the metal shell 2). The ground electrode 5 has a length extending in the axial direction of the spark plug 1 (i.e., the length of the upright portion 51). The length H of the tip protrusion 22 is smaller than that (i.e., the upright portion 51) of the ground electrode 5. The tip protrusion 22 extends substantially parallel to the longitudinal center line (i.e., the axis) of the spark plug 1 (i.e., the metal shell 2).

The ground electrode 5, as can be seen from FIGS. 1 and 3, includes the upright portion 51 and the horizontal portion 52. The upright portion 51 extends from the top end 21 of the metal shell 2 upward, as viewed in the drawings. The horizontal portion 52 extends from the front end of the upright portion 51 horizontally or at right angles to the upright portion 51 to have a center electrode-facing surface 53 which extends substantially perpendicular to the axis of the spark plug 1 and faces the tip 41 of the center electrode 4.

The diameter of the metal shell 2 is 10.2 mm. The thickness of the top end of the metal shell 2 is 1.4 mm. The widths W1 and W2 of the tip protrusion 22, as illustrated in FIG. 1, are 2.0 mm and 1.3 mm, respectively. The width W3 of the ground electrode 5 in the circumferential direction of the metal shell 2 is 2.6 mm.

The tip 41 of the center electrode 4 protrudes from the top of the porcelain insulator 3 in the axial direction of the spark plug 1 by 1.5 mm. The spark gap G is 1.1 mm.

The tip 41 of the center electrode 4 is a noble metal chip made of iridium. The metal shell 2 and the ground electrode 5 are each made of a nickel alloy.

The spark plug 1, as referred to herein, is designed for use in internal combustion engines for vehicles such as automobiles.

The function of the spark plug 1 will be described below with reference to FIGS. 1 to 4.

Figure 5:
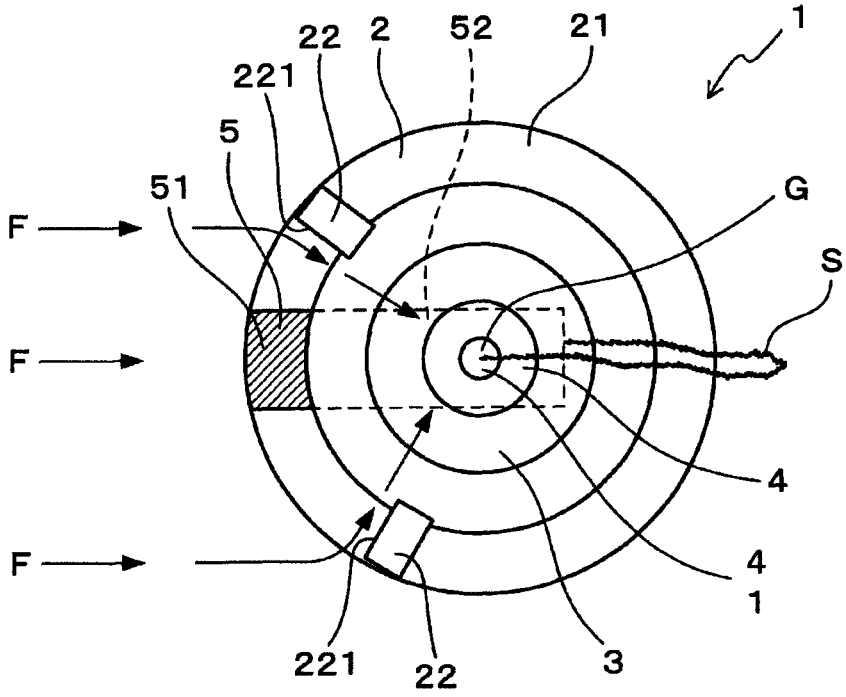
FIG. 5 is a partially sectional view which shows a top of a spark plug of the second embodiment.

The spark plug 1 is, as described above, equipped with the tip protrusion 22 extending from the top end 21 of the metal shell 2. The tip protrusion 22 works as a flow guide or a flow-directing member to direct a flow F (i.e., a swirl or a tumble) of an air-fuel mixture sprayed into the combustion chamber of the engine toward the top of the center electrode 4 (i.e., the spark gap G between the top of the ground electrode 5 and the tip 41 of the center electrode 4). The flow F is, as described above, a swirl or a tumble of the air-fuel mixture. For instance, when the upright portion 51 of the ground electrode 5 is, as illustrated in FIG. 5, located more upstream than the spark gap G in the flow F of the mixture, the tip protrusion 22 functions to change the orientation of the flow F having passed the side of the ground electrode 5 to the spark gap G, thereby avoiding a stall of the mixture around the spark gap G which is the problem underlying the prior art structure, as discussed in the introductory part of this application. This ensures the stability in igniting the air-fuel mixture in the combustion chamber of the engine.

Figure 4:
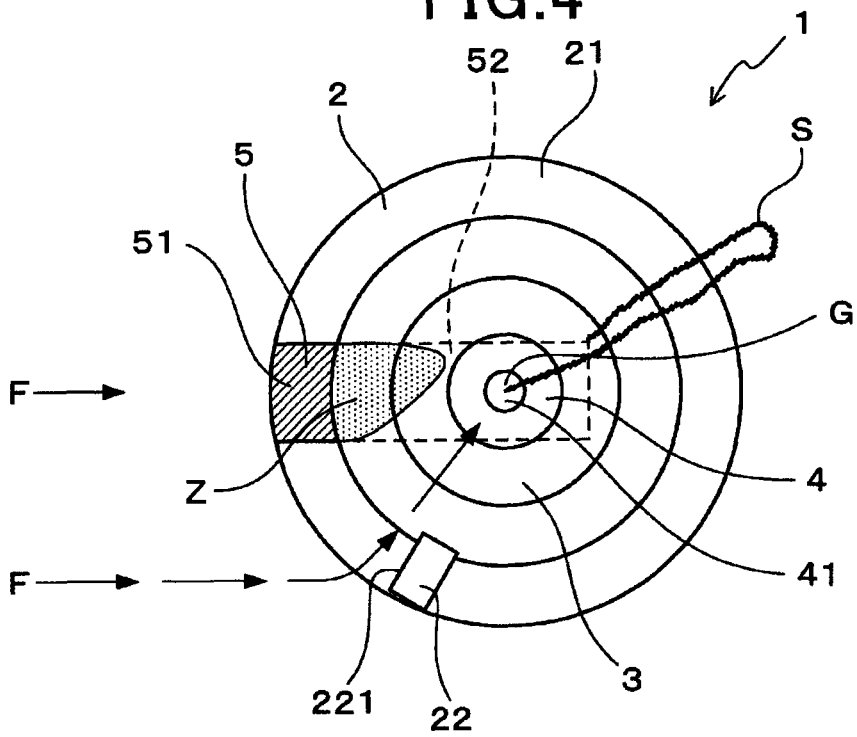
FIG. 4 is a traverse sectional view, as taken along the line A-A in FIG. 3.

A zone, as indicated by "Z" in FIGS. 3 and 4, represents the stagnation of the air fuel mixture.

The tip protrusion 22, as described above, has the side surface 221 facing in the circumferential direction of the spark plug 1 (i.e., the top end 21 of the metal shell 2). The side surface 221 works as a stream orientation control surface to guide the flow F of the mixture to the spark gap G. The use of the simple structure of the tip protrusion 22 eliminates the need for a complicated structure of the ground electrode 5 and ensures a desired degree of ignitability of the mixture.

The radial width W1 of the tip protrusion 22 is, as can be seen from FIG. 1, greater than the circumferential width W2 thereof, thereby enhancing the efficiency in directing the flow F of the mixture which will pass the circumference of the spark plug 1 toward the spark gap G and minimizing adverse effects arising from the obstruction of the upright portion 51 of the ground electrode 5 to the flow F of the mixture toward the tip of the spark plug 1. In other words, in the case where the upright portion 51 of the ground electrode 5 is located more upstream than the spark gap G, the greater the radial width W1 of the tip protrusion 22, the greater the volume of the mixture directed toward the spark gap G, while the greater the circumferential width W2 of the tip protrusion 22, the greater the degree of obstruction to the flow F of the mixture toward the spark gap G. The tip protrusion 22 is, therefore, designed to have the radial width W1 greater than the circumferential width W2 in order to maximize the effect of directing the flow F of the mixture to the spark gap G.

The circumferential width W2 of the tip protrusion 22 is, as illustrated in FIG. 1, smaller than the circumferential width W3 of the ground electrode 5, thereby minimizing the obstruction to the flow F of the mixture toward the spark gap G, that is, the stall thereof around the spark gap G.

As viewed in the axial direction of the spark plug 1 in FIG. 2, the angle α which the straight line L1 extending through the center of the center electrode 4 and the center of an upright portion 51 of the ground electrode 5 in the radius direction of the spark plug 1 makes with the straight line L2 extending through the center of the center electrode 4 and the side surface 221 of the tip protrusion 22 is less than or equal to 120°, thereby ensuring the function of the tip protrusion 22 to guide the flow F of the mixture to the spark gap G to improve the stability in igniting the mixture within the combustion chamber of the engine. It is advisable that the side surface 221 be aligned with the center of the top 41 of the center electrode 4 in the radial direction of the spark plug 1.

The length H of the tip protrusion 22 extending in the lengthwise or axial direction of the spark plug 1 is, as can be seen from FIG. 1, smaller than that of the upright portion 51 of the ground electrode 5, thereby avoiding an increase in overall length of the spark plug 1 and thus physical interference with the piston within the combustion chamber.

The tip protrusion 22 extends straight in parallel to the longitudinal center line (i.e., the axis) of the spark plug 1, in other words, does not have any bends, thus minimizing the stall of the flow F of the mixture around the tip protrusion 22.

The single tip protrusion 22 is disposed on the top end 21 of the metal shell 2. The use of the single tip protrusion 22 will cause the direction of the flow F of the mixture guided by the tip protrusion 22 to the spark gap G and that of another flow F of the mixture passing the ground electrode 5 to be asymmetrical with respect to the plane extending through the longitudinal center line of the upright portion 511 and the longitudinal center line of the center electrode 4. This minimizes the possibility of the mixture remaining around the spark plug 1.

FIG. 5 illustrates the spark plug 1 according to the second embodiment. The same reference numbers as employed in the first embodiment will refer to the same parts, and explanation thereof in detail will be omitted here.

The spark plug 1 includes two tip protrusions 22 joined to the top end 21 of the metal shell 2. The tip protrusions 22 are located at opposite sides of the ground electrode 5. In other words, the upright portion 51 of the ground electrode 5 lies between the tip protrusions 22.

The tip protrusions 22 are located to be asymmetrical with respect to the plane extending through the longitudinal center line (i.e., the length) of the upright portion 511 and the longitudinal center line (i.e., the length) of the center electrode 4. In other words, the angle α, as defined above, which the straight line L1 extending through the center of the center electrode 4 and the center of the upright portion 51 of the ground electrode 5 in the radial direction of the spark plug 1 makes with the straight line L2 extending through the center of the center electrode 4 and the side surface 221 of one of the tip protrusions 22 is different from that which the straight line L1 makes with the straight line L2 extending through the center of the center electrode 4 and the side surface 221 of the other tip protrusion 22.

Other arrangements are identical with those in the first embodiment, and explanation thereof in detail will be omitted here.

The tip protrusions 22 work as flow guides to direct flows F of the air-fuel mixture, as having passed circumferentially-opposed sides of the upright portion 51 of the ground electrode 5, toward the spark gap G.

The tip protrusions 22 are, as described above, asymmetrical with respect to the plane extending through the longitudinal center line of the upright portion 511 and the longitudinal center line of the center electrode 4. This causes, as illustrated in FIG. 5, the directions of the flows F of the mixture guided by the respective tip protrusions 22 to the spark gap G to be asymmetrical with respect to the plane extending through the longitudinal center line of the upright portion 511 and the longitudinal center line of the center electrode 4 in the case where the upright portion 51 of the ground electrode 5 is located more upstream than the spark gap G in the flows F of the mixture. This minimizes the possibility of the mixture staying around the spark plug 1. The structure of the spark plug 1 of the second embodiment also offers the other same effects as in the first embodiment.

FIGS. 6 to 9 illustrate a comparative example of a typical spark plug 9 equipped with the ground electrode 95 made up of the upright portion 951 and the horizontal portion 952.

Figure 6:
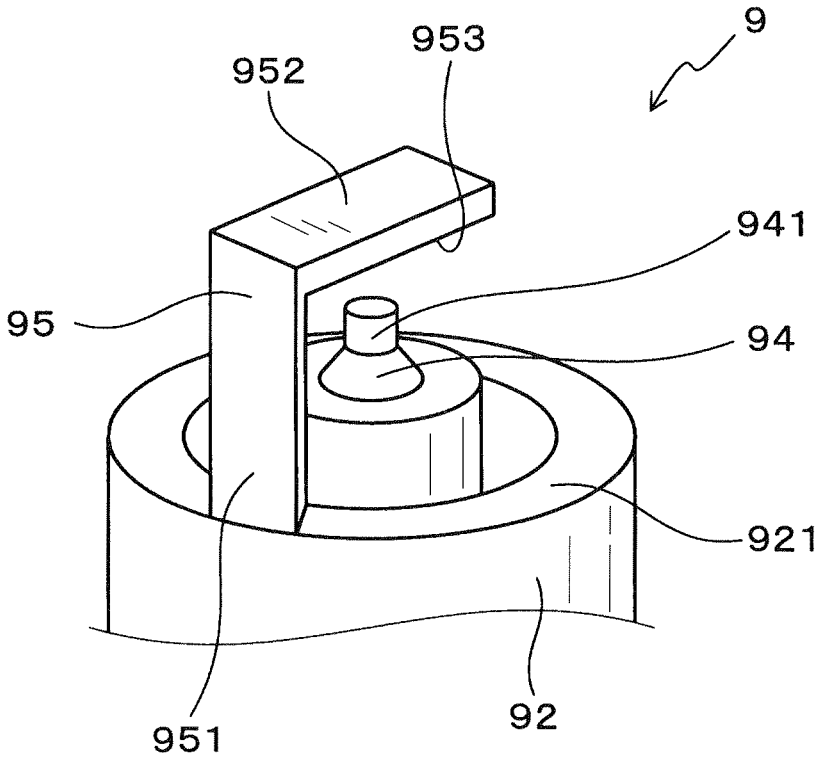
FIG. 6 is a partially perspective view which shows a comparative example of a conventional spark plug.

The ground electrode 95, as can be seen from FIG. 6, has the upright portion 951 extending from the top end 921 of the metal shell 92 and the horizontal portion 952 extending from the end of the upright portion 951 horizontally to have the center electrode-facing surface 953 which faces the tip 941 of the center electrode 94.

The spark plug 9 does not have the tip protrusion(s) 22, as discussed in the first and second embodiments. Other arrangements are identical with those in the first embodiment.

Figure 7A:
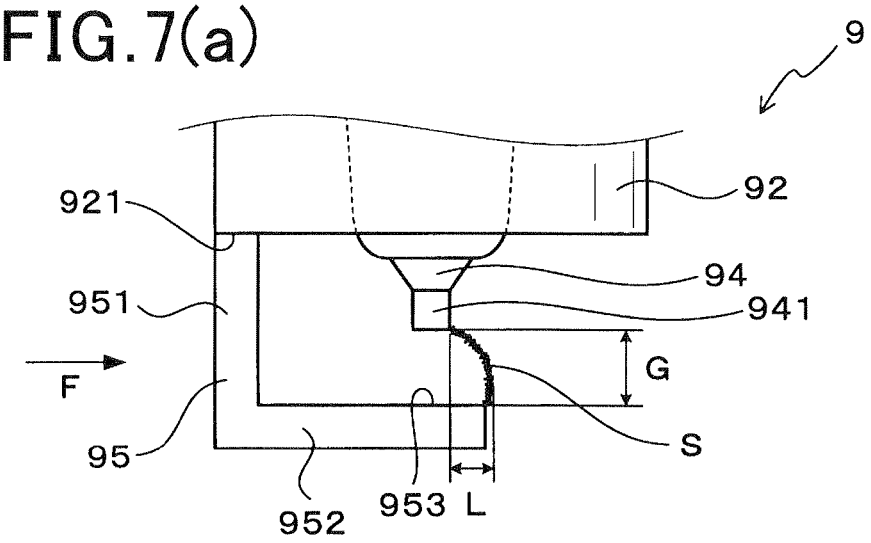
FIGS. 7(*a*), 7(*b*), and 7(*c*) are partially side views which illustrate patterns of a spark, as produced by the spark plug of FIG. 6, for different positional relations between a ground electrode and a flow of an air-fuel mixture.
Figure 7B:
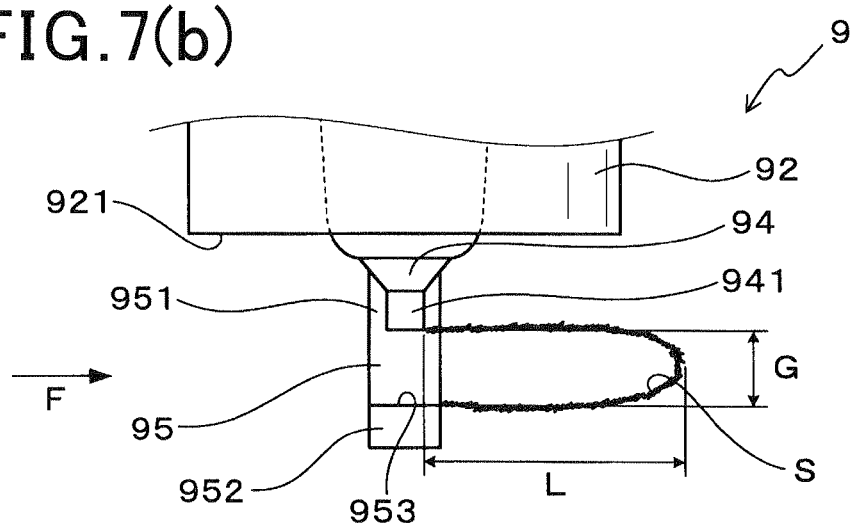
Figure 7C:
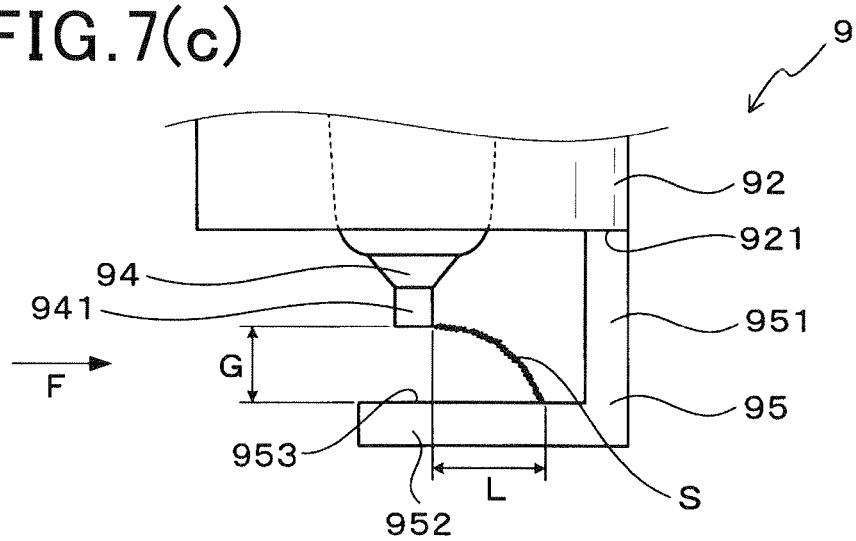

FIGS. 7(*a*), 7(*b*), and 7(*c*) demonstrate cases where the spark plug 9 is screwed into the head of an internal combustion engine (not shown) at different angular positions. The length L of an electric spark S, as can be seen from the drawing, depends upon the angular position of the spark plug 9 relative to the head of the engine, in other words, the direction of the flow F of the mixture relative to the upright portion 951 of the ground electrode 95.

Specifically, when the upright portion 951 of the ground electrode 95 is, as illustrated in FIG. 7(*a*), located more upstream than the spark plug G in the flow F of the mixture within the combustion chamber of the engine, the length L of the spark will be minimized.

When the upright portion 951 of the ground electrode 95 is, as illustrated in FIG. 7(*b*), aligned with the spark gap G in a direction perpendicular to the direction of the flow F of the mixture within the combustion chamber of the engine, the length L of the spark will be maximized.

When the upright portion 951 of the ground electrode 95 is, as illustrated in FIG. 7(*c*), aligned with the spark gap G in the direction of the flow F of the mixture within the combustion chamber of the engine, the length L of the spark will be intermediate between those in FIGS. 7(*a*) and 7(*b*).

Note that the length L of the spark S, as referred to herein, is defined by the circumferential edge of the tip 941 of the center electrode 94 and the top of the spark S (i.e., a portion of the spark S located farthest from the spark gap G in the radial direction of the spark plug 9).

Figure 8:
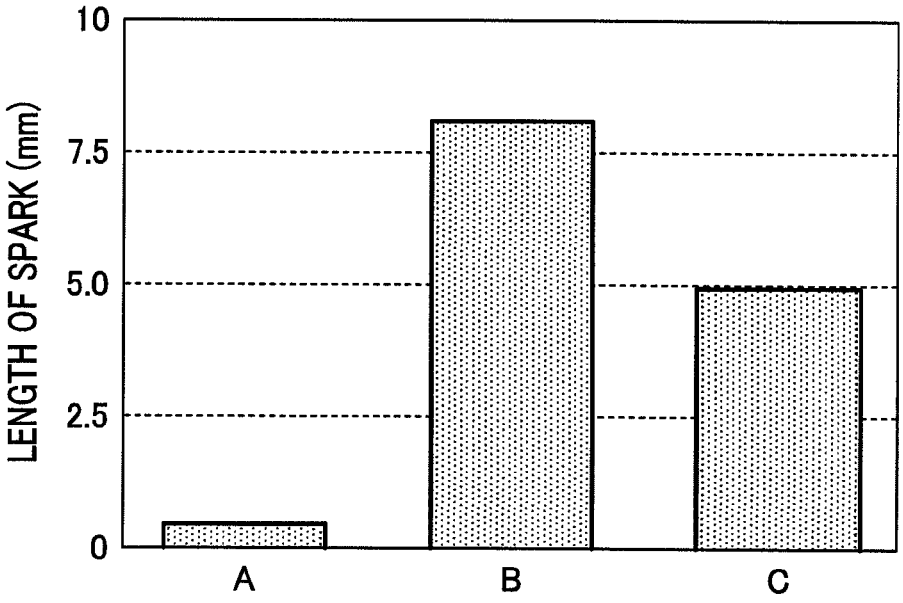
FIG. 8 is a graph which represents lengths of sparks produced by the spark plug when placed at angular positions, as illustrated in FIGS. 7(*a*) to 7(*c*)

The length L of the spark S, as demonstrated in FIGS. 7(*a*) to 7(*c*), was derived experimentally when the flow F of the mixture whose velocity was 15 m/s was created. FIG. 8 is a graph which represents the lengths L of the spark S in the examples of FIGS. 7(*a*), 7(*b*), and 7(*c*). The graph shows that the length L of the spark S depend directly upon the angular position of the spark plug 9 relative to the engine head (i.e., the direction of the flow F of the mixture).

Figure 9:
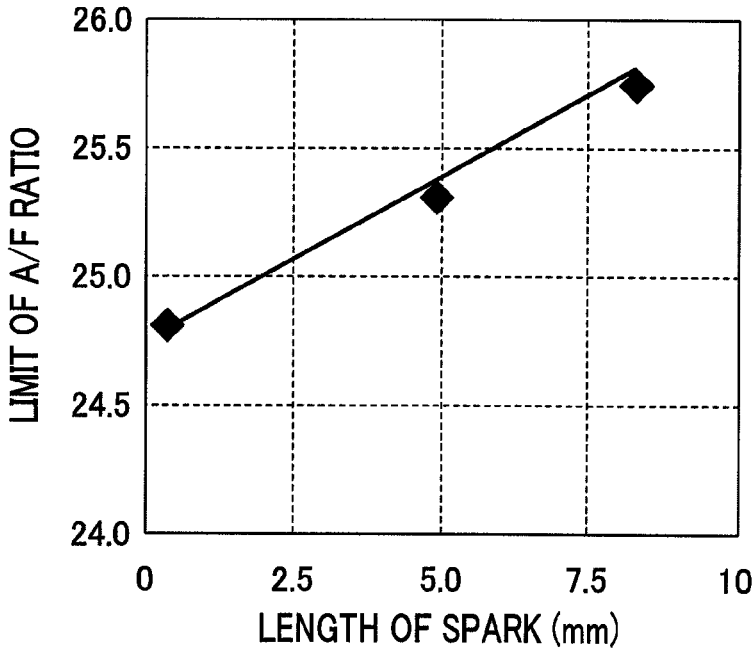
FIG. 9 is a graph which represents a relation between the length of a spark produced by the spark plug of FIG. 6 and a limit value of an air-fuel ratio range in which an air-fuel mixture is enabled to be ignited.

FIG. 9 is a graph which represents a relation between the length L of the spark S and the ignitability of the mixture. The graph shows that the greater the length L, the more the ignitability of the mixture is enhanced. The ignitability, as referred to herein, was evaluated experimentally by a limit value of an air-fuel (A/F) ratio at which the air-fuel mixture can be ignited. The greater the limit value of the air-fuel ratio, in other words, the leaner the mixture, the higher the ignitability of the mixture.

The graphs of FIGS. 8 and 9 show that the ignitability of the mixture (i.e., the ignition performance of the spark plug 9) depends greatly upon the angular position of the spark plug 9 relative to the engine head (i.e., the direction of the flow F of the mixture within the combustion chamber).

Example Test 1

Figure 10:
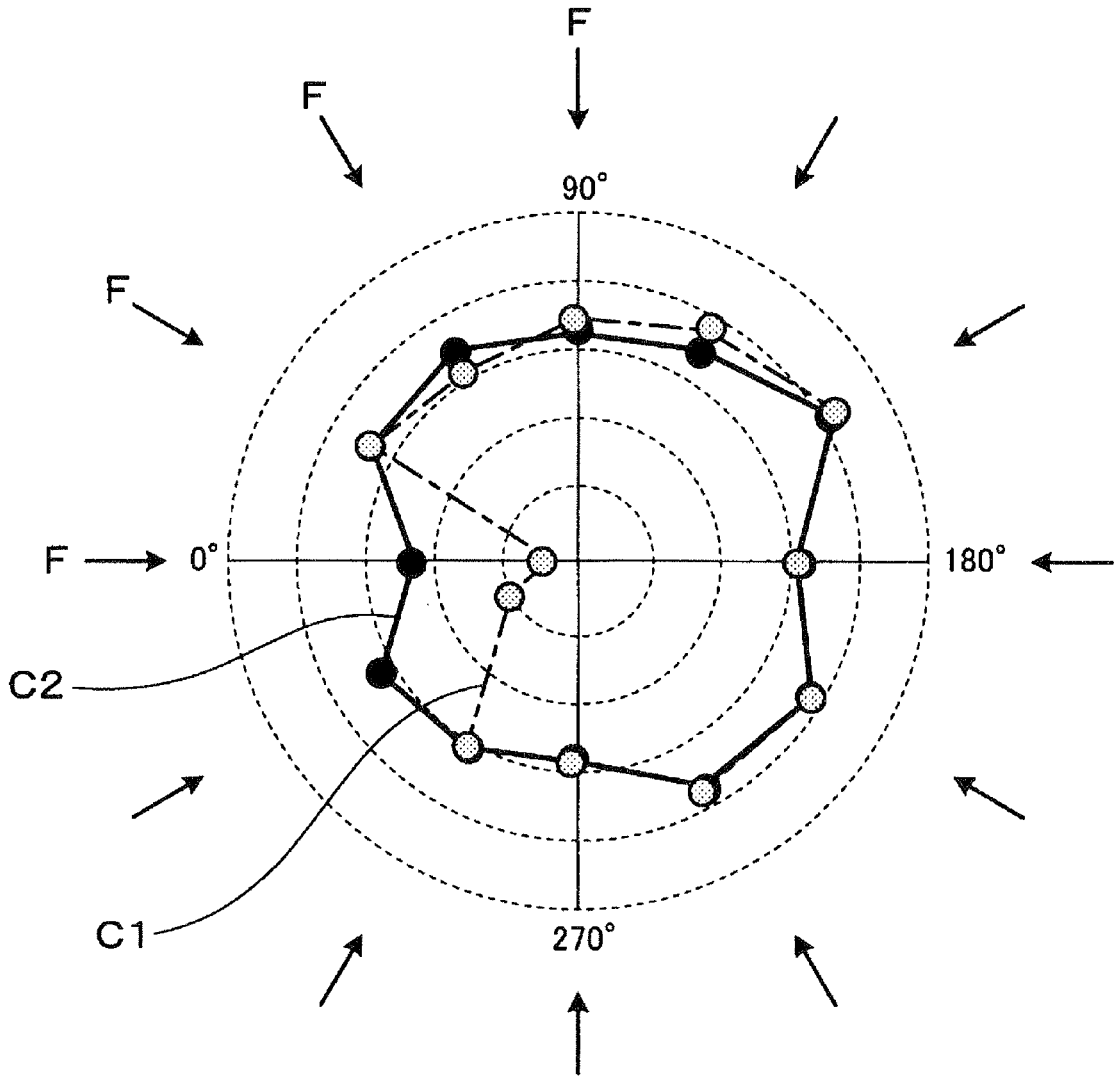
FIG. 10 is a line graph which represents a relation between a limit value (i.e., an ignitable limit) of an air-fuel ratio of an air-fuel mixture and angular positions of the spark plug of FIG. 6 when the velocity of a flow of the mixture is 14 m/s in an example test 1.
Figure 11A:
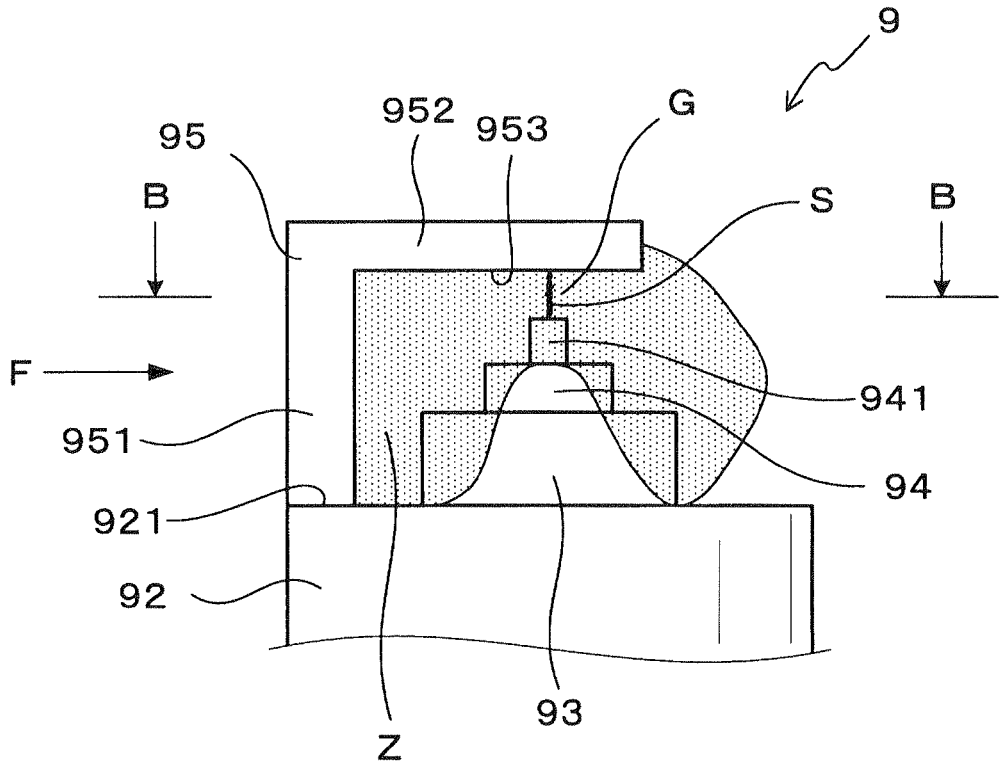
FIG. 11(*a*) is a partially side view which illustrates an air-fuel mixture flow stall range in the spark plug of FIG. 6 when an upright portion of a ground electrode is located more upstream than a spark gap in a flow of an air-fuel mixture.
Figure 11B:
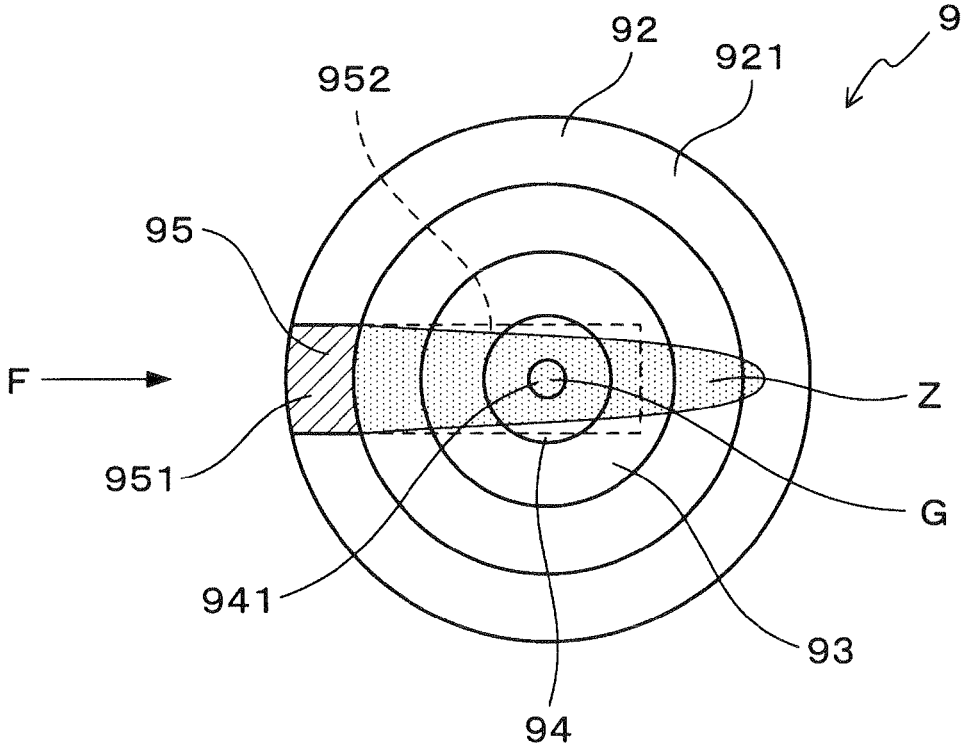

We performed tests, as illustrated in FIGS. 10, 11(*a*) and 11(*b*), on the spark plug 1 and the spark plug 9 to find how the limit value of the air-fuel ratio of the mixture changes in terms of the angular positions of the upright portions 51 and 951 of the ground electrodes 5 and 95.

We measured the limit value of the air-fuel ratio for different values of an angle β which the upstream direction of the flow F of the mixture makes with a line extending through the upright portion 51 of the ground electrode 5 and the spark gap G. The value of the angle β was changed in units of 30° between 0° to 330°. The angle β of 0° represents that the upright portion 51 of the ground electrode 5 is located more upstream than the spark gap G in the direction of the flow F of the mixture. The angle β of 180° represents that the upright portion 51 of the ground electrode 5 is located more downstream than the spark gap G in the direction of the flow F of the mixture. We performed the same tests on the spark plug 9.

In the tests on the spark plugs 1 and 9 to measure the limit value of the air-fuel ratio of the mixture, the direction of the flow F of the mixture was changed, as illustrated in FIG. 10. The velocity of the flow F was 14 m/s.

FIG. 10 represents limit values of the air-fuel ratio for different directions of the flow F of the mixture. A broken line C1 indicates results of the tests on the spark plug 9. A solid line C2 indicates results of the tests on the spark plug 1. The limit value of the air-fuel ratio is denoted by the dots and illustrated as increasing as each dot becomes further far from the center of concentric circles, as expressed by broken lines. In other words, the center of the concentric circles represents that the limit value of the air-fuel ratio is 24. The outermost one of the concentric circles represents that the limit value of the air-fuel ratio is 26. The other circles represent that the limit values of the air-fuel ratio are 24.4, 24.8, 25.2, and 25.6, respectively, from the inside to the outside.

In FIG. 10, the broken circle C1 representing a change in limit value of the air-fuel ratio in the spark plug 9 is of an irregular shape. This means that the ignitability of the mixture provided by the spark plug 9 depends greatly upon the direction of the flow F of the mixture, in other words, the angular orientation or position of the spark plug 9 mounted in the head of the engine. Particularly, it is found that when the angle β is 0°, the limit value of the air-fuel ratio is minimized, that is, that when the upright portion 951 of the ground electrode 95 is located most upstream in the flow F of the mixture, the ignitability of the mixture is most degraded. This is because the flow F of the mixture is, as illustrated in FIGS. 11(*a*) and 11(*b*), blocked by the whole of the upright portion 951 of the ground electrode 51 of the spark plug 9, so that most of the flow F stalls around the spark gap G. More specifically, when the spark gap G lies within the zone Z where the mixture almost stalls and stays, the spark S hardly expands until the length L of the spark S reaches a required value, thus resulting in a decrease in ignitability of the mixture.

In contrast to the spark plug 9, the solid circle C2 representing a change in limit value of the air-fuel ratio in the spark plug 1 is more regular in shape than the circle C1. This means that the ignitability of the mixture provided by the spark plug 1 is substantially kept regardless of the angular position of the spark plug 1 mounted in the head of the engine.

Example Test 2

We also performed tests on the spark plug 1 to find how the limit value of the air-fuel ratio of the mixture, as measured in the same manner as in the example test 1, changes with a change in angle α (see FIG. 2) when the angle β is O, that is, when the upright portion 51 of the ground electrode 5 is located most upstream in the flow F of the mixture.

We measured the limit value of the air-fuel ratio for different values of the angle α which, as described above, the straight line L1 extending through the center of the center electrode 4 and the center of the upright portion 51 of the ground electrode 5 in the radius direction of the spark plug 1, as viewed in the axial direction of the spark plug 1, makes with the straight line L2 extending through the center of the center electrode 4 and the side surface 221 of the tip protrusion 22. The value of the angle α was changed between 20° to 180°. We placed the spark plug 1 with the upright portion 51 of the ground electrode 5 located more upstream than the spark gap G in the flow F of the mixture within the combustion chamber of the internal combustion engine and measured the limit value of the air-fuel ratio of the mixture at which the mixture is enabled to be ignited by the spark plug 1. In the tests, the values of the angle α were set to 20°, 45°, 68°, 90°, 113°, 135°, and 180°.

Figure 12:
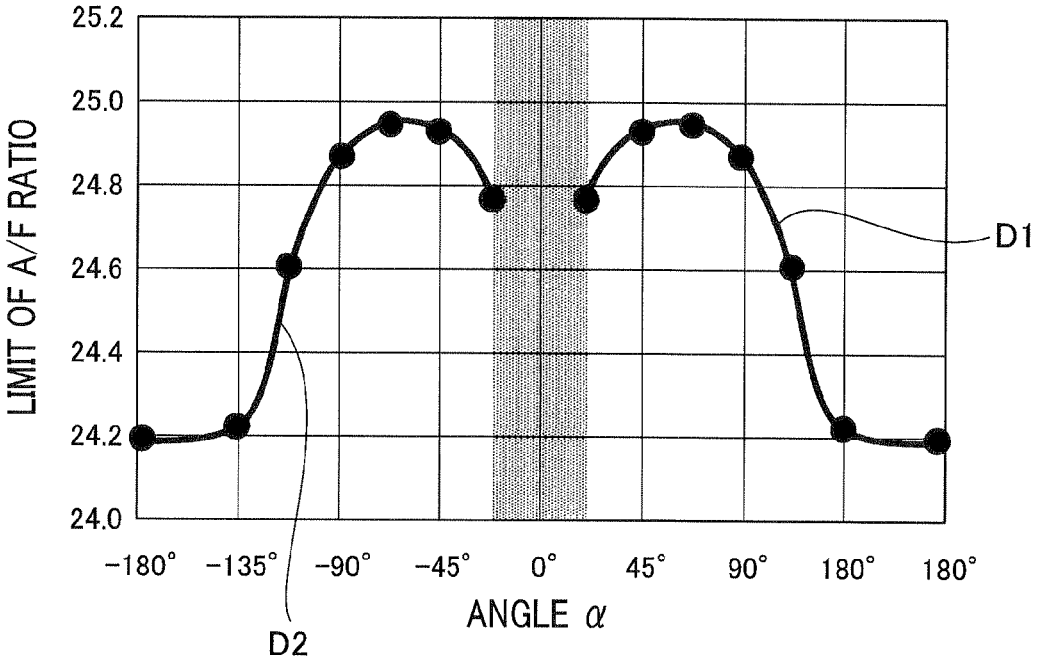
FIG. 12 is a graph which represents a line graph which represents a relation between a limit value of an air-fuel ratio of an air-fuel mixture and an angle $\alpha$ (i.e., an angular position of a tip protrusion relative to a ground electrode) in an example test 2.

We performed the tests in both cases where the tip protrusion 22 is located on opposite sides of the upright portion 51 of the ground electrode 5 in the circumferential direction of the metal shell 2 (i.e., the spark plug 1). "−180° to −45°" in the graph of FIG. 12 represents for the case where the tip protrusion 22 is disposed on the opposite side of the line L1 to the location where the tip protrusion 22 lies in FIG. 2. An absolute value of −180° to −45° is identical with the angle α, as indicated in FIG. 2.

The graph of FIG. 12 represents results of the above tests. The vertical axis indicates the limit value of the air-fuel ratio of the mixture. An upper side of the vertical axis denote a greater limit value of the air-fuel ratio. Specifically, in the graph of FIG. 12, the origin indicates when the limit value of the air-fuel ratio is 24. The uppermost horizontal line on the graph indicates 25.2. Other horizontal lines indicate 24.2, 24.4, 24.6, 24.8, and 25.0, respectively, from the lower side.

The line D1 represents the limit value of the air-fuel ratio of the mixture when the tip protrusion 22 is, as illustrated in FIG. 2, located on the counterclockwise side of the upright portion 51 of the ground electrode 5, while the line D2 represents the limit value of the air-fuel ratio of the mixture when the tip protrusion 22 is located on the clockwise side of the upright portion 51 of the ground electrode 5.

The graph of FIG. 12 shows that the limit value of the air-fuel ratio is high when the absolute value of the angle α is 90° or less, decreases when the absolute value of the angle α exceeds 90°, and is kept low when the absolute value of the angle α exceeds 120° and is greater than 135°, and that when the angle α is greater than or equal to 120°, the limit value of the air-fuel ratio will be 24.4 or more. It is, thus, found that when the angle α is less than or equal to 120°, preferably 90°, a desired degree of the ignitability of the mixture within the combustion chamber is ensured.

Example Test 3

We also performed tests on the spark plug 1 to evaluate the degree of efficiency in guide or direct the flow F of the air-fuel mixture to the spark gap G for different values of the radial width W/and the circumferential width W2 of the tip protrusion 22.

We prepared a plurality of samples of the spark plug 1 with different values of the widths W1 and W2 and placed, like in FIG. 2, each sample with the upright portion 51 of the ground electrode 5 located more upstream than the spark gap G in the direction of the flow F of the mixture. We measured the velocity of the flow F in the spark gap G. The velocity of the flow F before guided by the tip protrusion 22 was 18.5 m/s.

Each sample has the same structure as the spark plug 1 in the first embodiment except the widths W1 and W2 of the tip protrusion 22. Specifically, we prepared the sample Nos. 1, 2, 3, and 4 with the widths W1 and W2, as listed in the following table 1.

We also prepared the sample No. 5 with no tip protrusion 22.

TABLE 1

| Sample. | W1 (mm) | W2 (mm) | Velocity of mixture in spark gap (m/s) | Flow-directing percentage (%) |
|---|---|---|---|---|
| No. 1 | 2.6 | 1.3 | 16.2 | 88 |
| No. 2 | 1.8 | 1.3 | 14.8 | 80 |
| No. 3 | 1.3 | 1.3 | 4.5 | 24 |
| No. 4 | 1.3 | 1.8 | 7.3 | 39 |
| No. 5 | 0 | 0 | 1.8 | 10 |

where the flow-directing percentage represents a ratio of the velocity of the flow F of the mixture at the spark gap G to that before being directed by the tip protrusion 22 (i.e., 18.5 m/s) in percent and thus is a parameter indicating a degree to which the flow F is decelerated before reaching the spark gap G.

The table 1 shows that the sample Nos. 1 to 4 are higher in flow-directing percentage than the sample No. 5, but the sample Nos. 3 and 4 in which the tip protrusion 22 is shaped not to meet a relation of W/>W2 are lower in flow-directing percentage than the sample Nos. 1 and 2 which meet that relation and that the flow-directing percentage of the sample Nos. 1 and 2 is 80% or more desirably. It is, thus, found that the tip protrusion(s) 22 in each of the first and second embodiments is preferably so designed that the radial width W1 is greater than the circumferential width W2 in terms of the ignitability of the mixture within the combustion chamber of the engine.

Figure 13:
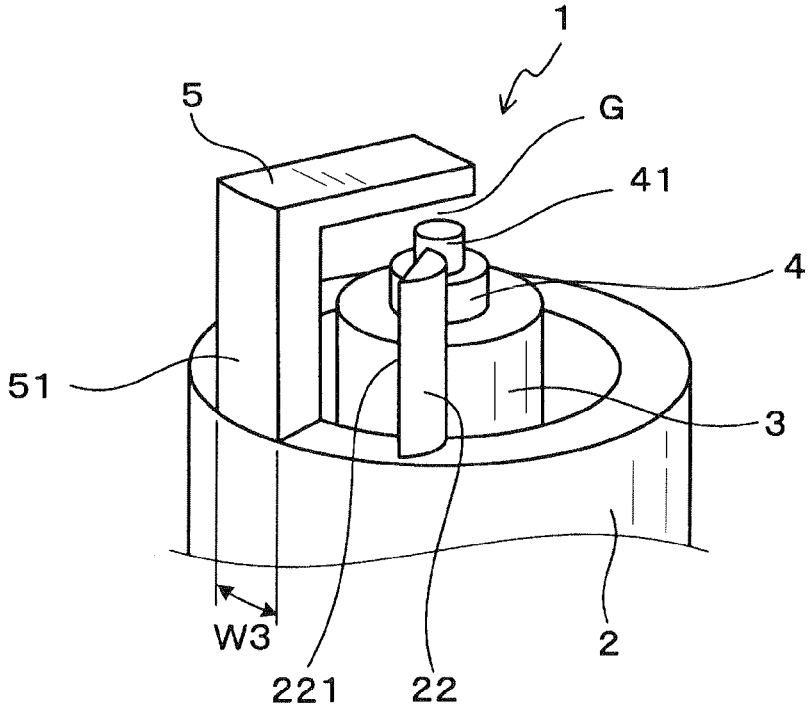
FIG. 13 is a partially perspective view which shows a spark plug of the third embodiment.
Figure 14:
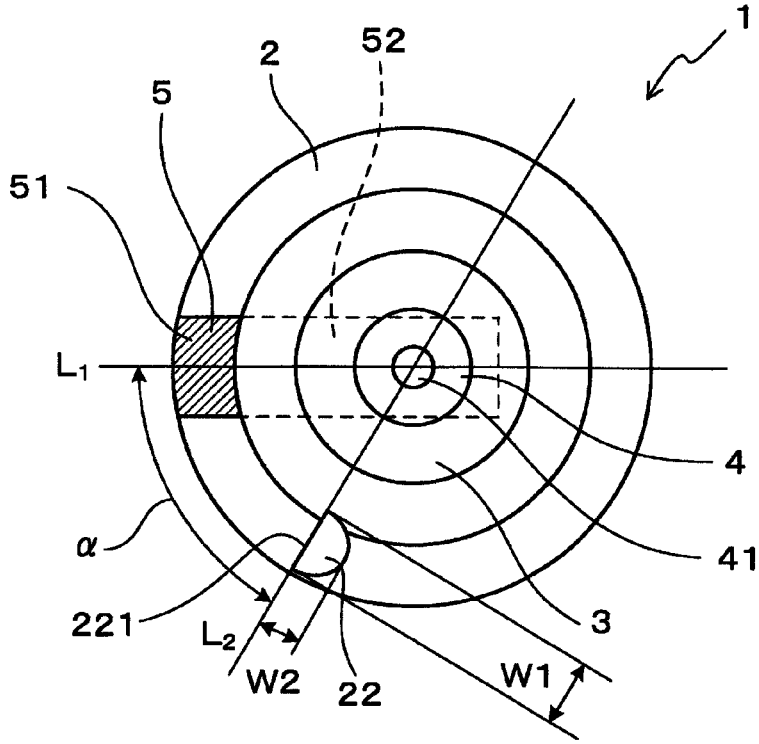
FIG. 14 is a partially sectional view which shows a top of the spark plug of FIG. 13.

FIGS. 13 and 14 illustrate the spark plug 1 of the third embodiment. The same reference numbers as employed in the above embodiment will refer to the same parts, and explanation thereof in detail will be omitted here.

The spark plug 1 is equipped with the tip protrusion 22 which is so shaped as to have a substantially semicircular or half-moon shaped cross section extending perpendicular to the length thereof (i.e., the length of the spark plug 1).

Specifically, the tip protrusion 22 has the flat side surface 221 facing the upright portion 51 of the ground electrode 5 and a round surface formed on the opposite side of the side surface 221. The side surface 221 is, as can be seen from FIG. 14, aligned with the center of the tip 41 of the center electrode 4, in other words, extends in the radial direction of the spark plug 1 and works, like in the above embodiments, as the flow-director to direct the flow F of the mixture to the spark gap G, thus ensuring a desired degree of the ignitability of the mixture within the combustion chamber of the engine. The radial width W1 of the tip protrusion 22 is, as can be seen from FIG. 14, greater than the circumferential width W2.

Other arrangements are identical with those in the first embodiment.

Figure 15:
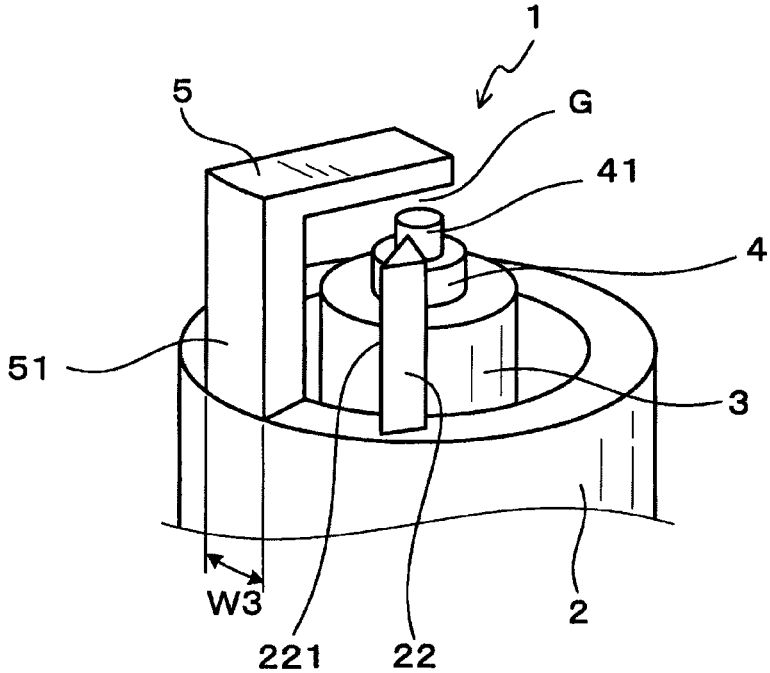
FIG. 15 is a partially perspective view which shows a spark plug of the fourth embodiment.
Figure 16:
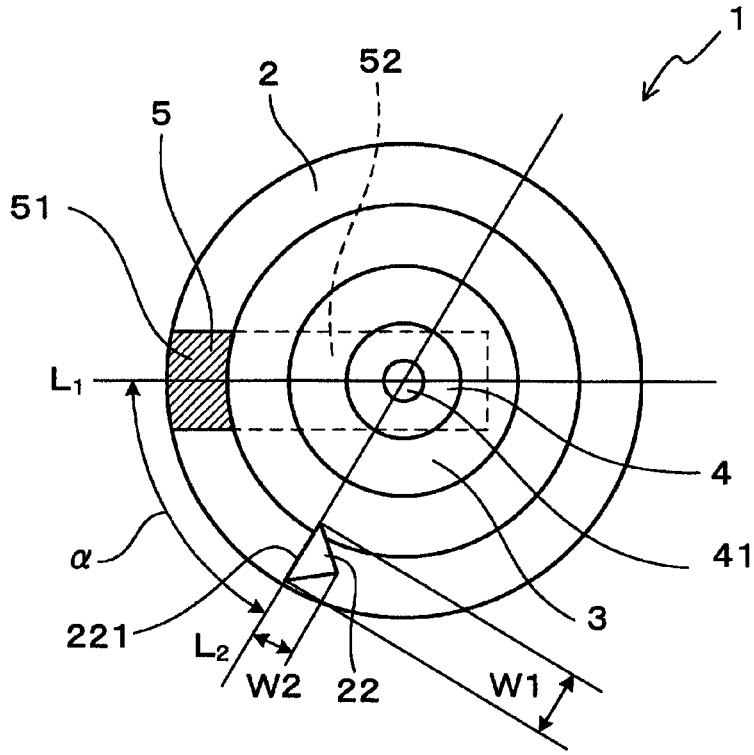
FIG. 16 is a partially sectional view which shows a top of the spark plug of FIG. 15.

FIGS. 15 and 16 illustrate the spark plug 1 of the fourth embodiment. The same reference numbers as employed in the above embodiment will refer to the same parts, and explanation thereof in detail will be omitted here.

The spark plug 1 is equipped with the tip protrusion 22 which is so shaped as to have a substantially triangular cross section extending perpendicular to the length thereof (i.e., the length of the spark plug 1).

The tip protrusion 22 has the flat side surface 221 whose cross section is defined by one of the three sides the triangle. The side surface 221 faces the upright portion 51 of the ground electrode 5. The side surface 221 is, as can be seen from FIG. 16, aligned with the center of the tip 41 of the center electrode 4, in other words, extends in the radial direction of the spark plug 1 and works, like in the above embodiments, as the flow-director to direct the flow F of the mixture to the spark gap G, thus ensuring a desired degree of the ignitability of the mixture within the combustion chamber of the engine. The cross section of the tip protrusion 22 in this embodiment is isosceles-triangular shaped and has the base thereof as the side surface 221. The radial width W1 of the tip protrusion 22 is, as can be seen from FIG. 16, greater than the circumferential width W2.

Other arrangements are identical with those in the first embodiment.

Figure 17:
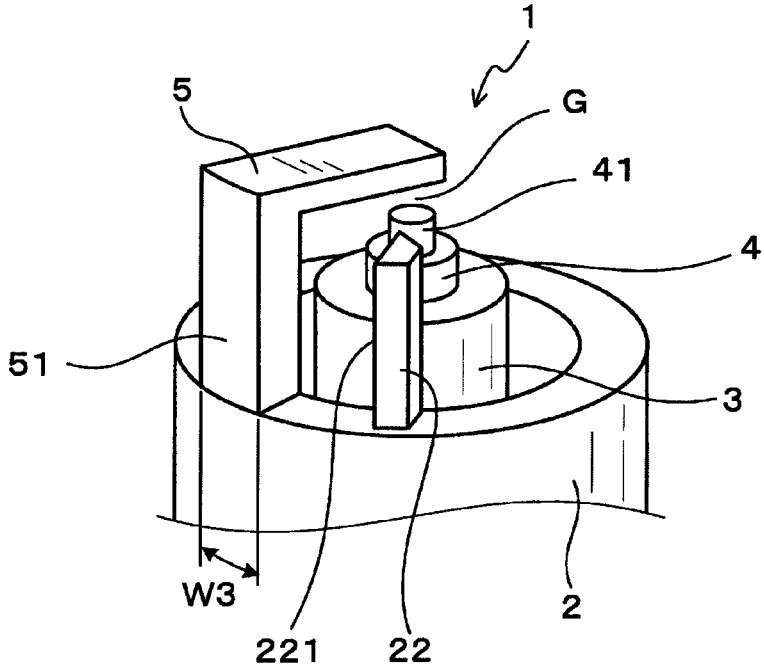
FIG. 17 is a partially perspective view which shows a spark plug of the fifth embodiment.
Figure 18:
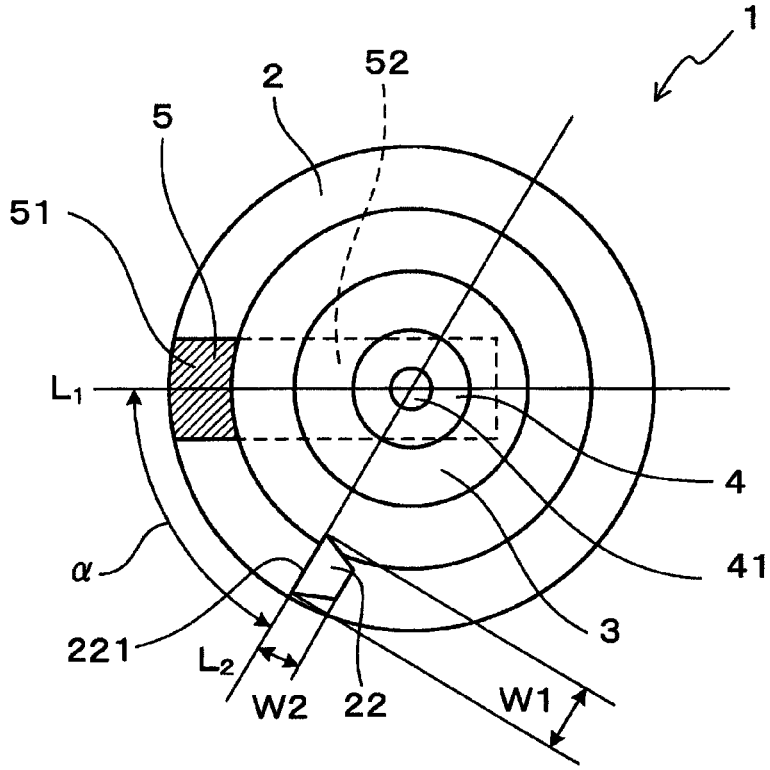
FIG. 18 is a partially sectional view which shows a top of the spark plug of FIG. 17.

FIGS. 17 and 18 illustrate the spark plug 1 of the fifth embodiment. The same reference numbers as employed in the above embodiment will refer to the same parts, and explanation thereof in detail will be omitted here.

The spark plug 1 is equipped with the tip protrusion 22 which is so shaped as to have a substantially trapezoidal cross section traversing the length thereof (i.e., the length of the spark plug 1).

The tip protrusion 22 has the flat side surface 221 whose cross section is defined by one of the four sides the trapezoid. Specifically, the cross section of the side surface 221 is defined by a longer one of the parallel bases of the trapezoid. The side surface 221 faces the upright portion 51 of the ground electrode 5. The side surface 221 is, as can be seen from FIG. 18, aligned with the center of the tip 41 of the center electrode 4, in other words, extends in the radial direction of the spark plug 1 and works, like in the above embodiments, as the flow-director to direct the flow F of the mixture to the spark gap G, thus ensuring a desired degree of the ignitability of the mixture within the combustion chamber of the engine. The radial width W1 of the tip protrusion 22 is, as can be seen from FIG. 18, greater than the circumferential width W2.

Other arrangements are identical with those in the first embodiment.

Figure 19:
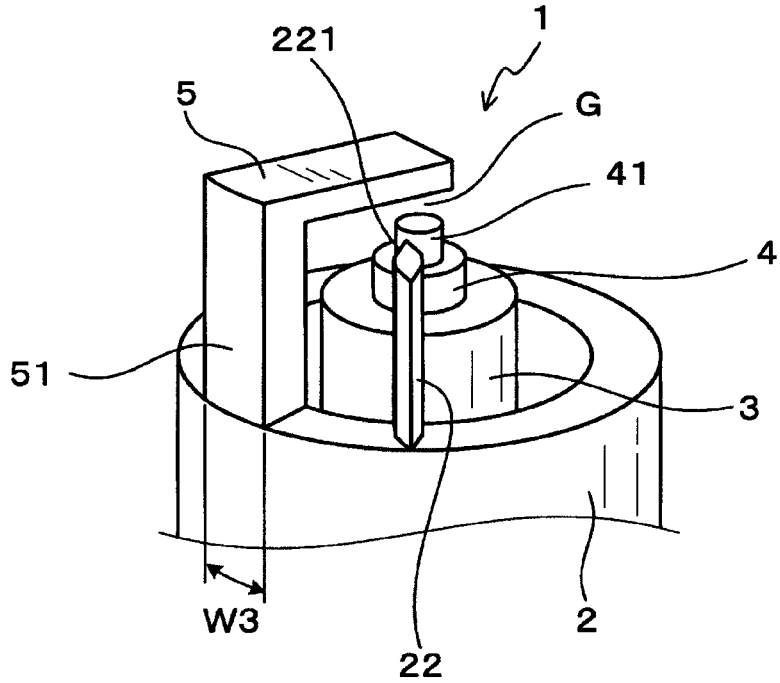
FIG. 19 is a partially perspective view which shows a spark plug of the sixth embodiment.
Figure 20:
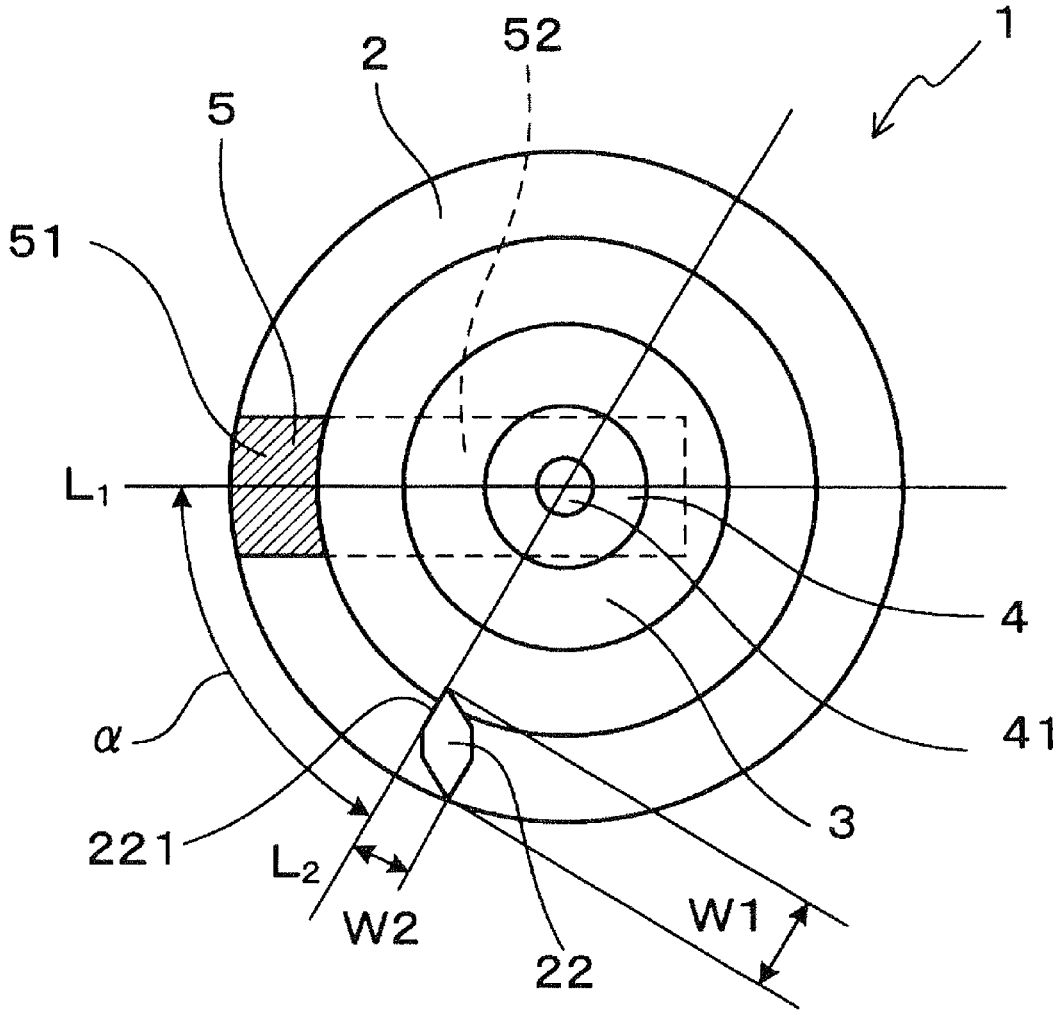
FIG. 20 is a partially sectional view which shows a top of the spark plug of FIG. 19.

FIGS. 19 and 20 illustrate the spark plug 1 of the sixth embodiment. The same reference numbers as employed in the above embodiment will refer to the same parts, and explanation thereof in detail will be omitted here.

The spark plug 1 is equipped with the tip protrusion 22 which is so shaped as to have a substantially hexagonal cross section traversing the length thereof (i.e., the length of the spark plug 1).

The tip protrusion 22 has the flat side surface 221 whose cross section is defined by one of the six sides the hexagon. The side surface 221 faces the upright portion 51 of the ground electrode 5 and is defined by one of the two sides of the hexagon which extend parallel to the radial direction of the metal shell 2 (i.e., the line L2). The one of the two sides is closer to the tip 41 of the center electrode 4. In other words, the side surface 221 is, as can be seen from FIG. 20, aligned with the center of the tip 41 of the center electrode 4 and works, like in the above embodiments, as the flow-director to direct the flow F of the mixture to the spark gap G, thus ensuring a desired degree of the ignitability of the mixture within the combustion chamber of the engine. The radial width W1 of the tip protrusion 22 is, as can be seen from FIG. 20, greater than the circumferential width W2.

Other arrangements are identical with those in the first embodiment.

The tip protrusion(s) 22 in each of the first to sixth embodiment may alternatively formed to have another shape in cross section as long as the radial width W1 is greater than the circumferential width W2.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

What is claimed is:

1. A spark plug for an internal combustion engine comprising:

a hollow cylindrical housing which has an open end;

a cylindrical porcelain insulator retained in the cylindrical housing;

a center electrode having a given length which is retained in the porcelain insulator with a tip thereof exposed outside an end of the porcelain insulator;

a ground electrode which is joined to the cylindrical housing so as to form a spark gap between itself and the tip of the center electrode; and a tip protrusion which extends from the open end of the cylindrical housing, the tip protrusion being shaped to have a radial width that is a width extending in a radial direction of the cylindrical housing and a circumferential width that is a width extending in a circumferential direction of the cylindrical housing, the radial width being greater than the circumferential width.

2. A spark plug as set forth in claim 1, wherein the ground electrode has a circumferential width which is a width extending in the circumferential direction of the cylindrical housing, and wherein the circumferential width of the tip protrusion is smaller than the circumferential width of the ground electrode.

3. A spark plug as set forth in claim 1, wherein the ground electrode has an upright portion extending from the cylindrical housing in a direction of the length of the cylindrical housing, and wherein an angle which a straight line extending through a center of the center electrode and a center of an upright portion of the ground electrode in the radial direction of the cylindrical housing makes with a straight line extending through the center of the center electrode and a side surface of the tip protrusion closer to the ground electrode on a plane extending perpendicular to an axial direction of the cylindrical housing is less than or equal to 120°.

4. A spark plug as set forth in claim 1, wherein the ground electrode has a length extending in an axial direction of the spark plug, and wherein the tip protrusion has a length extending from the open end of the cylindrical housing in the axial direction of the spark plug, the length of the tip protrusion being smaller than that of the ground electrode.

5. A spark plug as set forth in claim 1, wherein the tip protrusion extends substantially parallel to an axial direction of the spark plug.

6. A spark plug as set forth in claim 1, further comprising a second tip protrusion which extends from the open end of the cylindrical housing, and wherein the tip protrusion and the second tip protrusion are located to be asymmetrical with respect to a plane extending through a longitudinal center line of the ground electrode and a longitudinal center line of the center electrode.

7. A spark plug as set forth in claim 6, wherein the second protrusion is shaped to have a second radial width that is a width extending in the radial direction of the cylindrical housing and a second circumferential width that is a width extending in the circumferential direction of the cylindrical housing, the second radial width being greater than the second circumferential width.

8. A spark plug as set forth in claim 6, wherein the ground electrode has an upright portion joined at an end thereof to the open end of the cylindrical housing, the upright portion extending substantially in a direction in which the tip protrusion extends from the open end of the cylindrical housing, and wherein the tip protrusion is shaped to work as a flow-director to direct a flow of gas which is to be ignited by the spark plug.

* * * * *